United States Patent [19]

Kristofich

[11] Patent Number: 4,624,067

[45] Date of Patent: Nov. 25, 1986

[54] FRAME ASSEMBLIES

[76] Inventor: John F. Kristofich, 25 Jacob Rd., Washington Township, Washington County, N.J.

[21] Appl. No.: 558,790

[22] Filed: Dec. 7, 1983

Related U.S. Application Data

[63] Continuation-in-part of Ser. No. 440,004, Nov. 8, 1982.

[51] Int. Cl.[4] ..... A47G 1/06; G09F 1/12

[52] U.S. Cl. ..... 40/152.1; 40/152; 40/156; 40/158 R

[58] Field of Search ..... 40/490, 152, 152.1, 40/156, 158 R; 16/235, 254, 297; 248/460; 403/329

[56] References Cited

U.S. PATENT DOCUMENTS

| | | | |
|---|---|---|---|
| 440,201 | 11/1890 | Servus | 40/152.1 |
| 733,860 | 7/1903 | Mendel . | |
| 749,229 | 1/1904 | Servuss | 40/156 |
| 1,208,965 | 12/1916 | Hommel et al. | 40/152 |
| 1,375,858 | 4/1921 | Ott et al. | 40/152 |
| 1,815,436 | 7/1931 | Harris . | |
| 1,832,704 | 11/1931 | Hausner | 40/156 |
| 2,137,156 | 11/1938 | Clark | 40/158 R |
| 2,281,054 | 4/1942 | Smith et al. | 40/156 |
| 2,448,580 | 9/1948 | Crosby | 248/37 |
| 2,590,744 | 3/1952 | Woodbury | 40/156 |
| 3,030,057 | 4/1962 | Wright | 40/152.1 |
| 3,070,914 | 1/1963 | Henderson et al. | 40/156 |
| 3,074,680 | 1/1963 | Stewart | 248/224 |
| 3,186,117 | 6/1965 | Detje | 40/152.1 |
| 3,360,227 | 12/1967 | Overton et al. | 248/463 |
| 3,523,382 | 8/1970 | Dreyer | 40/152 |
| 3,529,374 | 9/1970 | Spertus | 40/152 |
| 3,722,122 | 3/1973 | Sesto | 40/152 |
| 3,978,631 | 9/1976 | Diersing | 52/239 |
| 4,017,989 | 4/1977 | Murray | 40/152 |
| 4,115,938 | 9/1978 | Belmuth et al. | 40/152 |
| 4,270,288 | 6/1981 | Sulzer | 40/156 |
| 4,286,400 | 9/1981 | MacPherson et al. | 40/152 |
| 4,413,435 | 11/1983 | Baur | 40/490 |

FOREIGN PATENT DOCUMENTS

| | | | |
|---|---|---|---|
| 85133 | 2/1896 | Fed. Rep. of Germany | 40/152.1 |
| 363385 | 11/1922 | Fed. Rep. of Germany | 40/152.1 |
| 2457759 | 6/1976 | Fed. Rep. of Germany | 40/156 |
| 551270 | 3/1923 | France | 40/152.1 |
| 893829 | 11/1944 | France | 40/152.1 |
| 307855 | 6/1955 | Switzerland | 40/152 |
| 5050 | of 1915 | United Kingdom | 40/152.1 |
| 176079 | 2/1922 | United Kingdom | 40/152.1 |
| 202732 | 8/1923 | United Kingdom | 40/152.1 |
| 293698 | 12/1928 | United Kingdom | 40/152.1 |
| 345138 | 3/1931 | United Kingdom | 40/152.1 |
| 363880 | 12/1931 | United Kingdom | 40/152 |
| 794772 | 5/1958 | United Kingdom | 40/152 |

*Primary Examiner*—Gene Mancene
*Assistant Examiner*—J. Hakomaki
*Attorney, Agent, or Firm*—Edward M. Blocker

[57] ABSTRACT

A versatile picture frame including a plurality of slidable arms connected to a back cover which engage a corresponding plurality of slots positioned along a skirt of the frame for quickly and easily securing an object to be displayed within the frame and for removing the same therefrom. The frame can also rest in a plurality of positions relative to a horizontal surface.

6 Claims, 14 Drawing Figures

FIG. 8
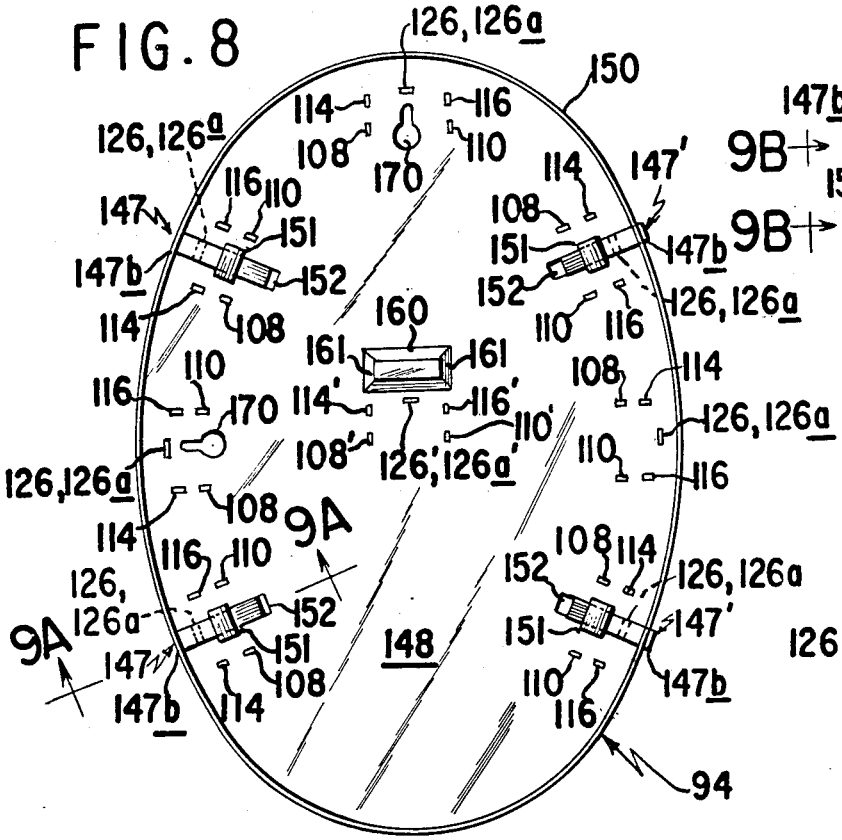
FIG. 9A
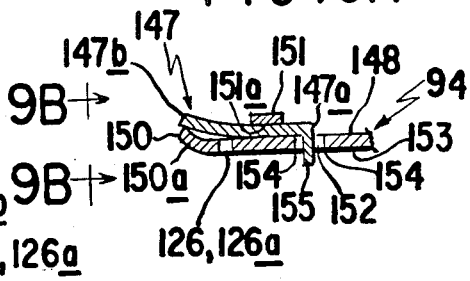
FIG. 9B
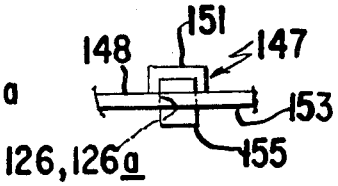
FIG. 10
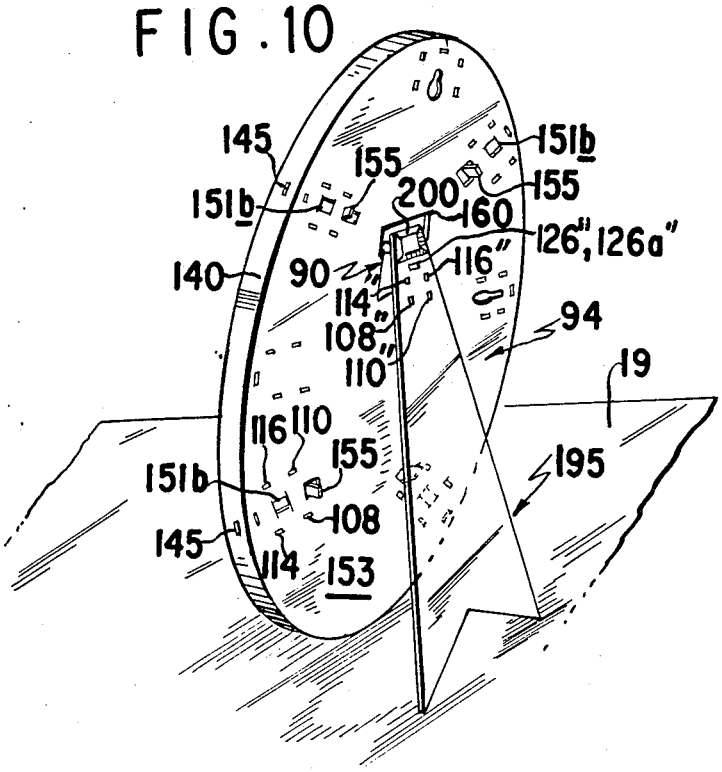
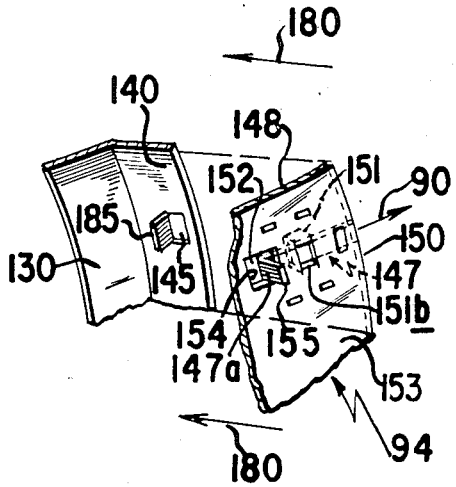
FIG. 11

FRAME ASSEMBLIES

REFERENCE TO RELATED APPLICATION

This application is a continuation-in-part of co-pending U.S. patent application Ser. No. 440,004 filed Nov. 8, 1982.

BACKGROUND OF THE INVENTION

1. Field of the Invention

The present invention relates to frames for displaying objects such as, but not limited to, pictures, and more particularly is directed to means for securing the displayed object within a frame at a plurality of angles relative to a horizontal surface on which the frame rests.

2. Description of the Prior Art

Frames, such as picture frames, typically are limited in their versatility. For example, individual frames are generally unable to be connected to other frames in a variety of geometric configurations for mounting on a wall or for resting on a horizontal surface. Additionally, the object to be displayed is typically secured within the frame by placing a back cover behind the object with protrusions, such as nails, holding the back cover in place. Such means for securement of the object are obviously cumbersome and do not afford quick and easy access to the object. Furthermore, a typical frame is unable to rest on a horizontal surface at a plurality of angles relative to the latter.

SUMMARY AND OBJECTS OF THE INVENTION

Accordingly, it is an object of the present invention to provide frame assemblies which overcome the drawbacks of the prior art.

More specifically, it is an object of the present invention to provide a new and improved frame assembly which provides quick and easy access to an object secured within the frame assembly.

It is a further object of the present invention to provide a frame assembly which quickly and easily secures the displayed object within the frame assembly.

It is yet another object of the present invention to provide a frame assembly which rests on a horizontal surface at a plurality of angles relative to the latter.

In accordance with one aspect of the present invention, a frame assembly comprises frame means for receiving and displaying an object which includes a rim, a skirt integral with the rim having a pluarlity of slots and a removable back cover for securing the object within the frame means; and connecting means slidably secured to the back cover and slidably engaging the slots for interlocking the back cover to the skirt.

In a feature of the present invention, the skirt includes an inner surface having ledges protruding therefrom for restricting movement of the back cover in a direction toward the rim so that when the back cover comes into contact with the ledges the plurality of slots are aligned with and able to receive the connecting means.

In another feature of the present invention, the connecting means comprises a plurality of arms, each arm having an elbow located at one end thereof. Still further, the back cover includes a plurality of arch-like means, integral therewith, for slidably receiving and securing the plurality of arms to the back cover.

In yet another feature of the present invention, each elbow passes through an aperture means of the back cover for restricting slidable movement of the arms upon contact with walls of the aperture means.

In another aspect of the present invention the frame assembly further comprises support means rotatably affixed to the frame means including a first end for resting on and stabilizing the frame means relative to a horizontal surface; and gear means which include first subgear means for affixation to said frame means, second subgear means for affixation to a second end of the support means and third subgear means for selectively positioning and releasably securing at one of a plurality of angles the first subgear means relative to the second subgear means such that the frame means can be selectively positioned and releasably secured at a plurality of angles relative to the support means.

The above, and other objects, features and advantages of the present invention will become readily apparent from the following detailed description which is to be read in conjunction with the accompanying drawings.

BRIEF DESCRIPTION OF DRAWINGS

The present invention is illustrated by way of example and not limitation in the figures of the accompanying drawings in which like numerals indicate similar elements and in which:

FIG. 8 is a plan view of a front surface of the back cover of one of the outside frames of FIG. 1;

FIG. 9A is a fragmentary, sectional view of the back cover taken along the lines 9A—9A of FIG. 8 and FIG. 9B is fragmentatry, side view of the back cover taken along the lines 9B—9B of FIG. 9A;

FIG. 10 is a perspective view, different from that shown in FIG. 1, of one of the outside frames of FIG. 1; and FIG. 11 is a fragmentary, exploded view of a frame rim and skirt and the back cover shown in FIG. 10.

DETAILED DESCRIPTION OF PREFERRED EMBODIMENTS

Various features to be described with respect to FIGS. 1-7 are similarly described in co-pending U.S. patent application Ser. No. 440,004.

Figure 1:
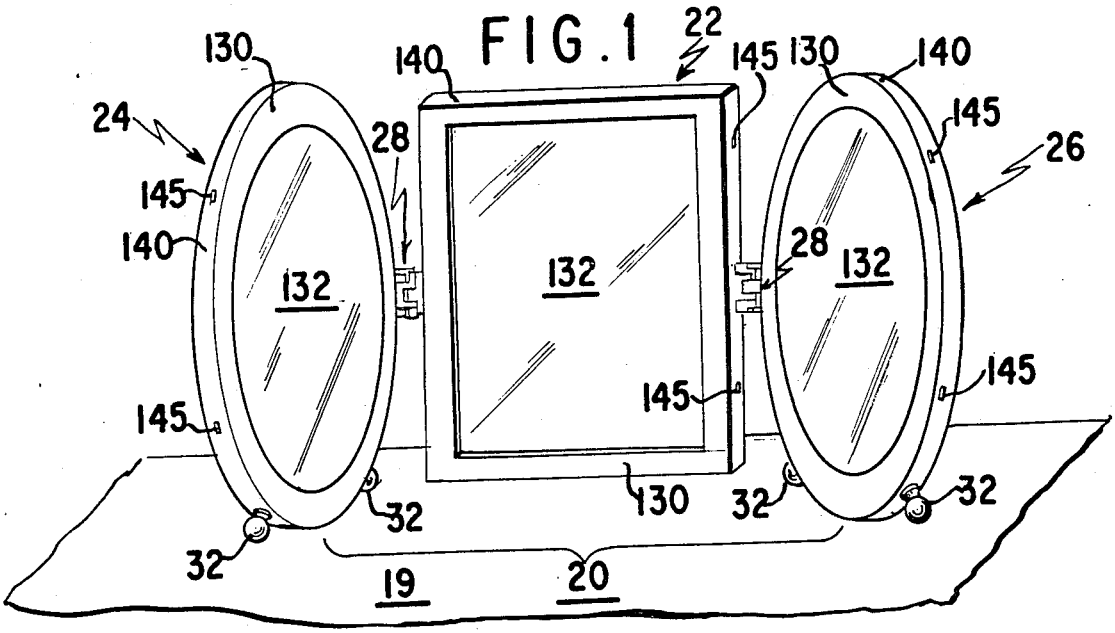
FIG. 1 is a perspective view of three interconnected frames adapted to be releasably secured at selectable angular dispositions with respect to one another.

FIG. 1 illustrates a frame assembly 20 resting on a horizontal surface 19. The assembly 20 includes a rectangular picture frame 22 and two oval picture frames 24 and 26, one on either side of frame 22. Oval frames 24 and 26 are interconnected to frame 22 by employing hinges 28, discussed in detail below. Additionally, each oval picture frame is provided with a pair of legs 32 for supporting the oval frame on horizontal surface 19.

Figure 2:
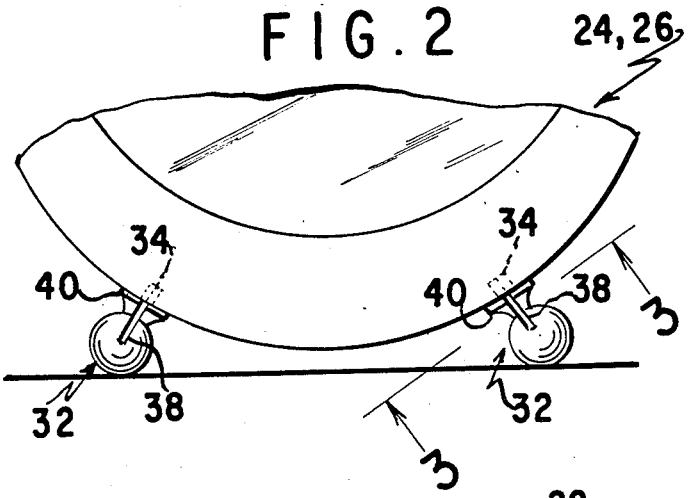
FIG. 2 is a fragmentary, elevational view of one of the outside frames of FIG. 1 illustrating the provision of removable legs for use in resting the frame on a horizontal surface.

Referring now to FIG. 2, the lower portion of one of the oval picture frames 24 and 26 is shown, with two legs 32 affixed thereto for supporting the frame 24 or 26 on the horizontal surface. For mounting the oval frames on a wall instead of resting it on a horizontal surface, legs 32 may be removed to enhance the ornamental appearance of the frame.

Figure 3:
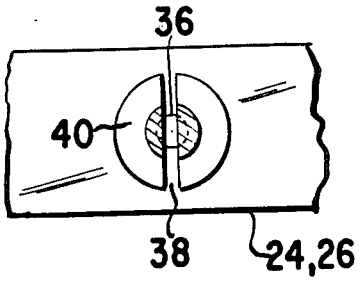
FIG. 3 is a sectional view taken along the lines 3—3 in FIG. 2.

As shown in FIG. 3, each leg is provided with an insert 34 adapted to be positioned in a corresponding aperture 36 in frame 24 or 26 for releasably affixing leg 32 to the frame. Each leg 32 is also provided with a slot 38, which extends through insert 34 so that the insert is resiliently collapsible. Insert 34 is shaped and dimensioned for being collapsably forced into aperture 36 so as to exert pressure thereagainst and resist removal therefrom. Each of the legs 32 includes a flange 40 adjacent to insert 34 which serves as a stop against frame 24 or 26. Accordingly, each flange 40 limits the depth of insertion of each leg into a corresponding insert 34 and also aids each leg in supporting one of the oval frames.

Figure 4:
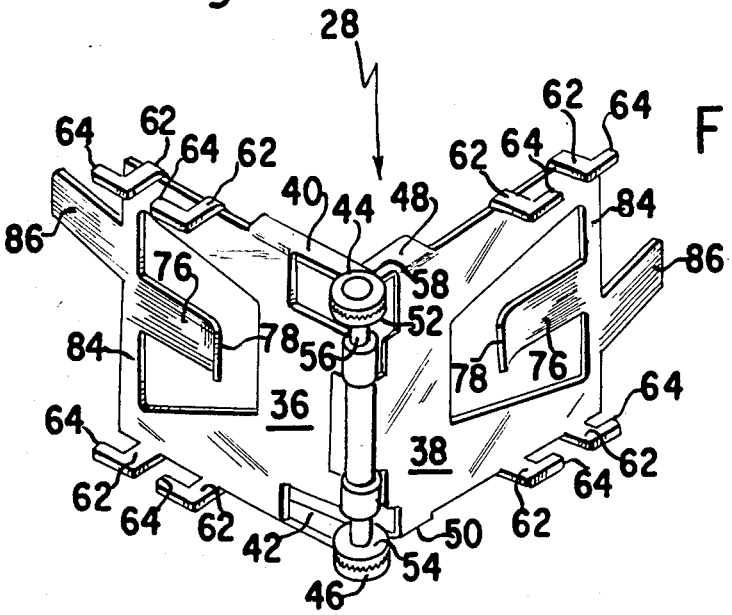
FIG. 4 is a perspective view of a hinge for interconnecting the frames as shown in FIG. 1 and for releasably securing each frame at a selectable one of a plurality of angular dispositions relative to a horizontal surface and to each other.

One embodiment of hinge 28 is illustrated in FIG. 4. Hinge 28 includes a first member 36 adapted to be releasably affixed to a first picture frame and a second member 38 adapted to be releasably affixed to a second picture frame. As will be discussed below, either member of hinge 28 is also adapted to be affixed to a support arm for resting on horizontal surface 19. Members 36 and 38 may be made, for example, of No. 1095 metal alloy, heat treated to spring temper. Member 36 has two portions 40 and 42 each bent toward the other and at right angles to member 36. Each of portions 40 and 42 has a rounded end 44 and 46, respectively, provided with a number of radiating teeth on a surface thereof facing inwardly toward the corresponding surface of the other end 44 or 46. Member 38 includes two portions 48 and 50 each bent toward the other and at right angles to member 38. Each of portions 48 and 50 has a rounded end 52 and 54, respectively, having a surface facing outwardly and provided with a number of radiating teeth meshed with the teeth of a corresponding one of rounded ends 44 and 46. Accordingly, each of the rounded ends 44, 46, 52 and 54 comprises a gear or serrated disk meshed with a corresponding one of the rounded ends. Each of the gears has a central aperture through which an axel 56 extends. Axel 56 is flattened at both ends, for example, as shown at 58, to maintain the axel in place. Portions 40 and 42 are biased against the corresponding portions 48 and 50 so that the meshed gears resist rotation with respect to one another on axel 56. However, if a sufficient force, that is, a sufficient torque is applied to members 36 and 38, the teeth of the gears will slide over one another to permit members 36 and 38 to rotate with respect to one another and assume a new angular disposition. Members 36 and 38 are each provided with two pairs of legs 62, each pair being located on a respective side edge of its member 36 or 38. Each leg has a projection 64 extending parallel to its respective member 36 or 38. As explained below, legs 62 can be connected to any of the picture frames 22, 24 or 26 so that members 36 and 38 are affixed to the frames, for example, as shown in FIG. 1.

Figure 5:
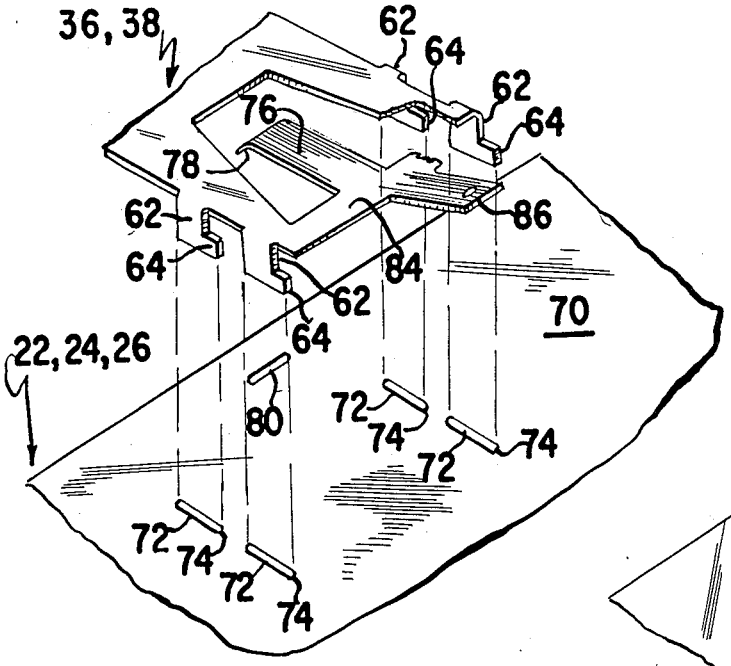
FIG. 5 is a fragmentary, perspective view of a portion of the hinge of FIG. 4 illustrating the manner in which the hinge is releasably secured to a back cover of one of the frames.

FIG. 5 illustrates the manner in which member 36 or 38 is affixed to one of the frames 22, 24 or 26. Each frame is provided with a back cover 70 made of sheet metal, such as aluminum, sized and shaped to fit within the inner surface of skirt 140. Four apertures 72 are stamped in cover 70. Apertures 72 are sized and positioned to permit each leg 62 with its projection 64 to be inserted into a corresponding aperture 72. Each aperture 72 has a lip 74 at one end thereof. After legs 62 are fully inserted in apertures 72, member 36 or 38 is slid to position each of projections 64 against an inner surface of a corresponding lip 74.

Members 36 and 38 are also each provided with a leg 76 having a projection 78 extending in a direction substantially opposite to the direction in which projections 64 extend. Additionally, which member 36 or 38 is positioned for coupling to back cover 70, leg 76 and projection 78 will extend in a direction toward back cover 70. Back cover 70 is provided with an aperture 80 sized and positioned so that, when projections 64 are fully inserted under lips 74, projection 78 snaps into aperture 80 to oppose the removal of projections 64 from engagement with the inner surfaces of lips 74. It will be readily appreciated from the foregoing that members 36 and 38 can be easily secured to frames 22, 24 and 26 so as to interconnect the frames, for example, as shown in FIG. 1. When interconnected by hinge 28, each pair of frames is releasably secured at a selected angular disposition relative to each other by applying a force, that is, a torque to the hinge transmitted through the frames which overcomes the resistance of the gears of hinge 28.

Each leg 76 is mounted on a torsion bar 84 of member 36 or 38. A tab 86 is mounted on a side of torsion bar 84 opposite leg 76 and angled slightly with respect to member 36 and 38 so that tab 86 is raised slightly away from back cover 70 when member 36 or 38 is coupled thereto. Tab 86 provides a convenient means for removing projection 78 of leg 76 from aperture 80 to permit the decoupling of member 36 or 38 from one of the frames. More specifically, member 36 or 38 is decoupled from frame 22, 24 or 26 by pressing tab 86 toward cover 70 so as to apply a moment through torsion bar 84 to pull projection 78 away from aperture 80 whereupon legs 64 are removed from apertures 72.

Figure 6B:
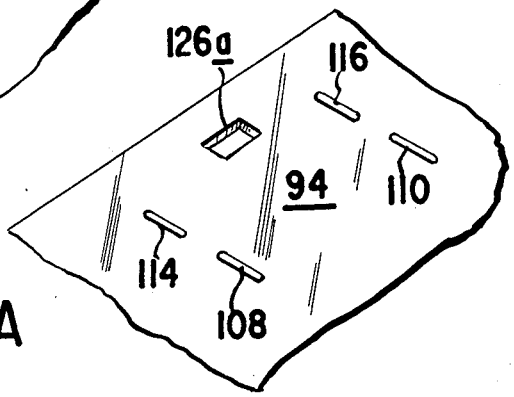
FIG. 6B is a fragmentary, perspective view of a modified back cover used with the hinge shown in FIG. 6A.
Figure 6A:
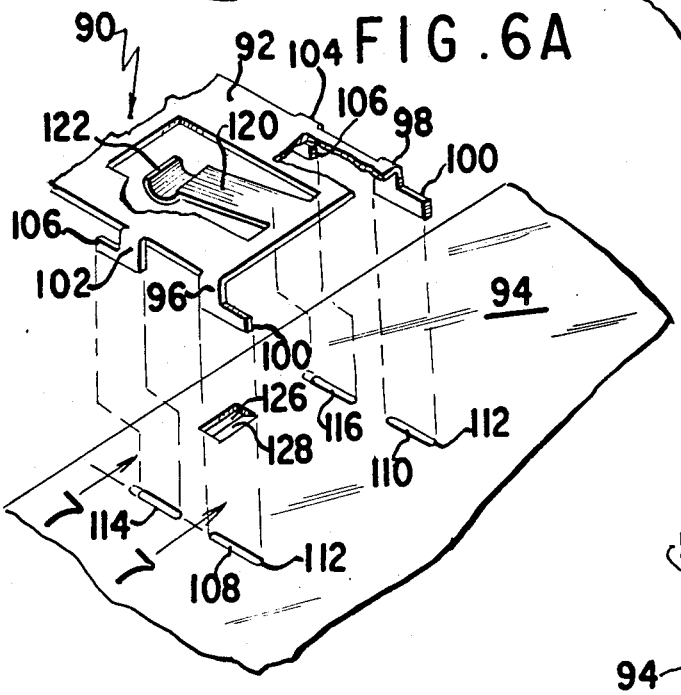
FIG. 6A is a fragmentary, perspective view of a modified hinge and a back cover

Referring now to FIG. 6A, a fragmentary, perspective view of a modified hinge 90 is provided for use in interconnecting the picture frames and for releasably securing each frame at a selectable one of a plurality of angular dispositions relative to a horizontal surface and to each other. A member 92 is adapted to connect hinge 90 to a back cover 94 of a picture frame. Hinge 90 also includes a second member (not shown), which may be constructed in the same manner as member 92, for use in affixing the hinge 90 to a second picture frame or to the previously mentioned support arm (to be discussed below). Hinge 90 further includes a rotatable, geared mechanism (not shown) such as that included in hinge 28 of FIG. 4. Member 92 may be made, for example, of No. 1095 metal alloy, heat treated to spring temper. Member 92 includes first legs 96 and 98 which extend from opposite sides of member 92 and at right angles thereto. Each of legs 96 and 98 has a projection 100 which extends in a first direction parallel to member 92. Member 92 also includes second legs 102 and 104 each extending from a respective side of member 92 at a right angle thereto. Each of legs 102 and 104 has a projection 106 which extends in a second direction opposite to the first direction and parallel to member 92. Member 92 is also provided with a leg 120 affixed to member 92 at one end of leg 120. Leg 120, which is made of spring metal to permit resilient bonding thereof, is angled from member 92 slightly toward back cover 94 when member 92 is aligned for coupling with back cover 94. At an opposite end of leg 120 is a rounded projection 122 having a convex surface relative to back cover 94 when member 92 is aligned for coupling with cover 94. Back cover 94 is also provided with a depression 126 having a sloped edge 128.

To affix member 92 to back cover 94, legs 96 and 98 are initially inserted into corresponding apertures 108 and 110 in back cover 94 (as shown by phantom lines in FIG. 6A) such that projections 100 are slid under lips 112 of apertures 108 and 110. Back cover 94 also includes apertures 114 and 116 sized and positioned so that, after projections 100 of legs 96 and 98 have been fully inserted under lips 112, legs 102 and 104 may be inserted in apertures 114 and 116, respectively. Once all legs of member 92 have been inserted into their corresponding apertures, the convex surface of projection 122 will be in contact with back cover 120. By then sliding member 92 in a direction opposite to that used to insert projections 100 under lips 112, projection 122 will be captured by depression 126. Depression 126 is sized to permit projection 122 to slide over edge 128 and into the depression and is sufficiently shallow so that leg 120 is bent slightly away from back cover 94 once within the depression. Alternatively, and as shown in FIG. 6B, projection 122 can be captured utilizing an opening **126*a* rather than depression 126. Due to the resilient properties and slight angle of leg 120 relative to back cover 94, as projection 122 is intercepted by opening 126*a* projection 122 falls into and is thereby captured by opening 126*a*. As will be now readily appreciated, through the capture of projection 122 by depression 126 or opening 126*a*, projections 100 are maintained under lips 112. Consequently, member 92 is securely affixed to and prevented from being removed from back cover 94**.

Figure 7A:
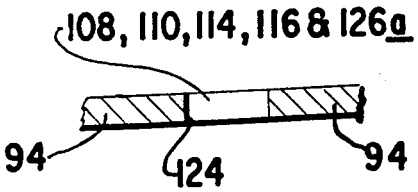
FIGS. 7A and 7B are fragmentary, sectional views taken along the lines 7—7 in FIG. 6A.
Figure 7B:
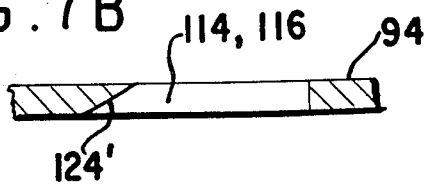

Referring now to FIG. 7A, each of apertures 108, 110, 114 and 116 as well as opening **126*a* has a rectangular cross sectional area. Apertures 114 and 116 have lips 124 which are perpendicular in angle relative to member 92. Alternatively, and as shown in FIG. 7B, apertures 114 and 116 have inwardly facing lips 124' angled relative to apertures 114 and 116. Consequently, projections 106 are forced under cover 94 as they slide over lips 124'. In both FIGS. 7A and 7B, as projections 106 are slid under lips 124 and 124', respectively, and after capture by either depression 126 or 126*a*, leg 120 is forced toward member 92. Dimensions of all elements shown in FIGS. 6A, 6B, 7A and 7B are selected so that, when projection 122 is fully extended into depression 126 or opening 126*a*, projections 100 remain at least partially under lips 112**.

In removing member 92 from back cover 94, member 92 is initially slid in the first direction used to insert projections 100 under lips 112 so as to draw projection 122 away from depression 126 or opening **126*a*. Legs 102 and 104 are then lifted from apertures 114 and 116. Legs 96 and 98 then may be easily removed from apertures 108 and 110**.

Referring once again to FIG. 1, picture frames 22, 24 and 26 each include a bezel or rim 130 and a glass faceplate 132 held in place at its edges by rim 130. Rim 130 may be made, for example, of 70/30 brass, No. 752 alloy (nickel/sterling silver), or gold. Each frame also has a skirt 140 integral with rim 130 having a plurality of slots 145.

For purposes of further discussion, rim 130 and skirt 140 of frame 24 or 26 rather than frame 22 will be shown in FIGS. 8–11. It will be readily appreciated, however, that the elements to be described hereinafter are not limited to frames 24 and 26 and can be used for frames of varying size and shape including frame 22. Furthermore, in discussions regarding FIGS. 8 and 10, features identified with hinge 90 will be used. It is to be understood, however, that hinge 28 can be used wherever hinge 90 or its associated features are mentioned.

Referring now to FIG. 8, a plurality of arms 147 having at least one pair of substantially planar opposing surfaces are located near a periphery 150 of a front surface 148 of back cover 94. Each arm 147 has a first end **147*b* which, as described below, slidably engages with one of the plurality of slots 145. Arms 147' denote those arms 147 which have been slid past periphery 150. Front surface 148 of back cover 94 is substantially flat. Back cover 94 also has a substantially flat rear surface 153. The planar opposing surfaces of arms 147 are substantially parallel to front surface 148. As shown in FIGS. 9A and 9B, each arm 147, which comprises a flexible material such as 1075 spring tempered steel but not limited thereto, slidably extends through an arch-shaped portion 151 integral with back cover 94 and has an elbow 147*a* located at the second end of arm 147. In manufacturing back cover 94, arch-shaped portions 151 are formed by offsetting, that is, pushing out back cover 94 in those areas where portions 151 are desired as denoted by reference 151*b* in FIG. 10. Elbow 147*a* extends in a direction which is both substantially perpendicular to the direction of the planar opposing surfaces of arm 147 and through one of a plurality of openings 152 of back cover 94 so as to rise to an end 155 which is above rear surface 153. Each opening 152 has a pair of walls 154** forming the inner surface thereof.

Back cover 94 further comprises a plurality of sets of apertures 108, 110, 114, 116 and 126 or **126*a* spaced about periphery 150 to permit frame 24 or 26 to be interconnected to other frames, such as shown in FIG. 1. The dimensions and positions of these apertures are selected in accordance with the selection of the hinge chosen. Back cover 94 is also slightly beveled near periphery 150 denoted by reference 150*a* in FIG. 9A. Consequently, each arm 147 in spanning between periphery 150 and an opening 152, is pressed against an inner surface 151*a* of one of the arch-shaped portions 151. Each arm 147 is therefore slightly bent and biased against both periphery 150 and back cover 94 near opening 152. Accordingly, each arm 147 is prevented from freely sliding through one of the arch-shaped portions 151** unless pushed by an external force as discussed below.

Referring once again to FIG. 8, a plateau 160, having beveled sides 161, rises slightly above front surface 148. Accordingly, the object to be displayed in frame 24 or 26 will rest against and be securely held in place between glass faceplate 132 and the combination of plateau 160 and arch-like portion 151. Additionally, back cover 94 has a slight depression (not shown) on rear surface 153 opposite plateau 160. For purposes of hanging frame 24 or 26 on a wall, cutout portions 170 of back cover 94 are provided for receiving picture hooks or other similar projections.

Referring now to FIG. 11, in assembling frame 24 or 26 the object to be displayed is placed within the frame so as to rest against rim 130 and on skirt 140. Back cover 94 is then inserted within frame 24 or 26 in a direction as indicated by arrows 180 with ends 155 of elbows 147*a* at or behind periphery 150 so as to avoid contact with skirt 140. For purposes of restricting the inward movement of back cover 94 (as indicated by arrows 180) and in order for the plurality of arms 147 to be aligned with the corresponding plurality of slots 145 of skirt 140, a plurality of ledges 185 protruding from the inner surface of skirt 145 are provided. Ledges 185 are adjacent to slots 145 and between the same and rim 150. As will be readily appreciated, as back cover 94 is inserted within skirt 140, back cover 94 will contact the plurality of ledges 185 restricting further inward movement of the back cover. The plurality of arms 147 then can be slidably moved, as indicated by arrow 190, by pushing ends 155 of elbows 147*a* in a direction so that ends 147*b* of arms 147 are received by the plurality of slots 145. Each arm 147 is halted in its slidable movement upon elbow 147*a* coming into contact with walls 154. Additionally, each opening 152 is dimensioned so as to permit sufficient slidable movement of each arm 147 for engagement with a corresponding slot 145 but to prevent end 147*b* from extending so far through the corresponding slot so as to be readily noticed by the public. Once the plurality of arms 147 are slid into the plurality of slots 145, back cover 94 is secured to and interlocked with skirt 140 for holding the displayed object within frame 24 or 26.

In removing the displayed object from frame 24 or 26, a force is exerted against end 155 of each elbow 147*a* in a direction opposite to arrow 190. Back cover 94 is then no longer secured to skirt 140 and can be readily removed therefrom so as to permit access to the displayed object. Back cover 94 typically is a metal, such as steel or aluminum steel, although other materials can be used, provided that the various apertures and openings previously described in connection therewith can be formed. A vinyl cover or other attractive material may be attached to rear surface 153 if desired provided that the various apertures and openings formed in back cover 94 also can be formed in the vinyl cover or other attractive material.

For purposes of supporting frame 24 or 26 on horizontal surface 19, a support arm or prop 195, as shown in FIG. 10, having apertures 108", 110", 114", 116" and 126" or 126*a*" similar to apertures 108, 110, 114, 116 and 126 or 126*a*, respectively, is provided near a first end thereof. Support arm 195 is typically a metal such as aluminum but is not limited thereto. The other end of support arm 195 rests on horizontal surface 19 for stabilizing frame 24 or 26 relative to surface 19. Support arm 195 is also slightly raised near the first end thereof at area 200 and forms a corresponding slight depression (not shown) on the opposite side af arm 195. A hinge, such as hinge 90, has the legs of one member, such as member 92 inserted into the apertures of support arm 195 and has the legs of the other member of the hinge inserted into apertures 108', 110', 114', 116' and 126 or 126*a*' of rear surface 153 as shown in FIG. 8. Apertures 108', 110', 114', 116' and 126' or 126*a*' are located near the depression opposite plateau 160 of back cover 94 and are the same as previously mentioned apertures 108, 110, 114, 116 and 126 or 126*a*, respectively. Insertion of the lips of the hinge are the same as previously described in connection with hinge 28 or 90. The depressed areas opposite area 200 and plateau 160 of support arm 195 and back cover 94 serve to accommodate, that is, form a relief for the protrusion of hinge 94 around the axel thereof where the gears mesh. Accordingly, by supplying a force, that is, a torque to hinge 90 transmitted through rotary movement of the frame relative to support arm 195, support arm 195 can be selectively positioned and releasably secured at a plurality of angles relative to frame 24 or 26.

Furthermore, if at any time it is desired to remove the support arm, for example, to permit mounting of the frame on a wall, hinge 90 can be easily removed from back cover 94 as previously described. Hinge 90 also can be easily and similarly detached from support arm 195, if desired.

In view of the foregoing, it now will be readily appreciated that the present invention provides a new and improved versatile frame. More particularly, the frame permits an object, which is to be displayed within the frame, to be quickly and easily secured therein or removed therefrom. Additionally the frame can rest on a horizontal surface in a plurality of positions and also can be interconnected to other frames in a plurality of different configurations.

Having specifically described illustrative embodiments of the invention with reference to the accompanying drawings, it is to be understood that the invention is not limited to these precise embodiments and that various changes and modifications may be effected by one skilled in the art without departing from the scope and spirit of the invention as defined by the appended claims.

I claim:

1. For use in connecting a frame to an article such as a second frame or support member, wherein said frame and article each include at least two apertures spaced apart a predetermined distance, a hinge comprising:

a first member adapted to be connected to said frame, a second member adapted to be connected to said article, and means pivotaly connecting said first and second members together, said first and second members each including (a) at least a pair of legs terminating in projections adapted to be received within respective pairs of said apertures and (b) means for locking said projections within their associated apertures.

2. A hinge according to claim 1, wherein each of said first and second members includes two pairs of said legs.

3. A hinge according to claim 1, wherein said means for pivotally connecting allows said first and second means to be secured in a multiplicity of angular relationships relative to each other.

4. A hinge according to claim 3, wherein said first and second members each include at least one serrated disk and means for biasing said serrated disks against each other to enable said first and second members to be secured in a multiplicity of angular relationships relative to each other.

5. A hinge according to claim 1, wherein said locking means comprises a lip extending from each of said members and terminating in a projection adapted to engage a slot in said frame or article.

6. A hinge according to claim 4, wherein said locking means comprises a lip extending from each of said members and terminating in a projection adapted to engage a slot in said frame or article.

* * * * *